US005438782A

United States Patent [19]

Belobraydich et al.

[11] Patent Number: 5,438,782

[45] **Date of Patent: * Aug. 8, 1995**

[54] SIGN SYSTEM WITH RIB LOCK MECHANISM

[75] Inventors: Tood Belobraydich, Downers Grove; Jeffrey A. Williams, Westmont, both of Ill.

[73] Assignee: The Dicke Tool Company, Downers Grove, Ill.

[ * ] Notice: The portion of the term of this patent subsequent to Aug. 3, 2010 has been disclaimed.

[21] Appl. No.: 308,954

[22] Filed: Sep. 20, 1994

Related U.S. Application Data

[63] Continuation of Ser. No. 63,074, May 12, 1993, which is a continuation of Ser. No. 713,805, Jun. 12, 1991, Pat. No. 5,231,778.

[51] Int. Cl.[6] ..... G09F 15/00

[52] U.S. Cl. ..... 40/610; 40/603; 40/607; 403/397; 403/396

[58] Field of Search ..... 40/610, 611, 612, 606, 40/608; 248/165, 166, 188.7; 403/109, 108, 397, 396, 393, 353

[56] References Cited

U.S. PATENT DOCUMENTS

| | | | |
|---|---|---|---|
| 691,050 | 1/1902 | Dronne . | |
| 2,025,004 | 12/1935 | Shearer | 40/145 |
| 2,917,813 | 12/1959 | Ackermann et al. | 29/80 |
| 3,620,496 | 11/1971 | Bolt et al. | 248/171 |
| 3,677,511 | 7/1972 | Dicke | 248/448 |
| 3,899,843 | 8/1975 | Doyle et al. | 40/125 G |
| 4,019,271 | 4/1977 | Latimer | 40/125 H |
| 4,059,915 | 11/1977 | Owens | 40/125 H |
| 4,232,467 | 11/1980 | Stewart | 40/607 |
| 4,288,053 | 9/1981 | Sarkisian | 248/218.4 |
| 4,309,836 | 1/1982 | Knapp | 40/602 |
| 4,433,935 | 2/1984 | Main et al. | 403/385 |
| 4,490,934 | 1/1985 | Knapp | 40/603 |
| 4,507,887 | 4/1985 | Seely | 40/606 |
| 4,548,379 | 10/1985 | Seely et al. | 248/624 |
| 4,569,499 | 2/1986 | Seely | 248/624 |
| 4,572,473 | 2/1986 | Seely | 248/624 |
| 4,593,879 | 6/1986 | Seely et al. | 248/624 |
| 4,691,892 | 9/1987 | Grewe et al. | 248/624 |
| 4,694,601 | 9/1987 | Dicke et al. | 40/610 |
| 4,886,232 | 12/1989 | Dicke et al. | 248/576 |
| 4,954,008 | 9/1990 | Dicke et al. | 403/24 |
| 5,231,778 | 8/1993 | Belobraydich et al. | 40/610 |

*Primary Examiner*—Kenneth J. Dorner
*Assistant Examiner*—Cassandra Davis
*Attorney, Agent, or Firm*—Fitch, Even, Tabin & Flannery

[57] ABSTRACT

A stand for mounting a device having a rib member includes a mast, with a pair of spaced mounting clips secured to the mast. The mounting clips are spaced from the outer surface of the mast so as to form pockets therewith for receiving the rib member. Upon insertion between the mounting clips, the rib member is pivoted for entry into the pockets and a locking pin receivable in an aperture in the rib member prevents a dislocating pivoting in an opposite direction.

28 Claims, 3 Drawing Sheets

SIGN SYSTEM WITH RIB LOCK MECHANISM

This application is a continuation of application Ser. No. 08/063,074, filed May 12, 1993, which is a continuation of application Ser. No. 07/713,805, filed Jun. 12, 1991, now U.S. Pat. No. 5,231,778.

BACKGROUND OF THE INVENTION

1. Field of the Invention

The present invention pertains to portable signs, and in particular, to portable folding signs typically used on a temporary basis. The present invention also pertains to the temporary mounting of devices other than signs.

2. Description of the Related Art

Signs are used for a wide variety of applications, both indoors and outdoors. One application, for example, is to post a temporary warning or alert notice adjacent a construction site or roadside work location. As will be appreciated by those skilled in the art, signs intended for outdoor use must be carefully designed to accommodate wind loadings which can be quite substantial, especially for larger sign panels, 48 inches or larger. In order robe commercially attractive, the sign should be capable of set-up by a single worker, even in a wide variety of weather and climate conditions. For example, a sign should be capable of ready assembly even in cold conditions which reduce manual dexterity, or in applications where gloves and other hand protection must be worn. It is important in temporary applications that a sign be reusable, storable in a compact space and readily erected on demand. In particular, it is important that the sign be easily displayed at the beginning of a work session without elaborate preparations, and thereafter stowed away when the warning or alert is no longer needed. One such sign which has met with widespread commercial acceptance is that employing a foldable sign panel, available from Dicks Tool Company, assignee of the present invention, as Part No. 3000. The sign panel is made of fabric and can thereby be rolled up for compact storage, thus making the maximum use of limited space available on a construction vehicle. Thus, it is possible to carry a number of frequently used sign panels on the construction vehicle at all times, thus allowing greater flexibility in scheduling the work assignments of a particular vehicle. The sign panel includes a pair of fiber glass ribs which are overlapped and pinned at their centers so as to provide a "scissors action" when assembling or disassembling the sign. The mounting base used with the sign is of a type similar to that described in U.S. Pat. No. 4,886,232 assigned to the assignee of the present invention.

The components of a sign should be versatile, interchangeable with other signs of a similar type, and ideally new sign systems should accommodate existing sign components whenever possible. If modification to the existing sign components is necessary for use with a new sign system, the modifications should be as simple to perform as possible.

SUMMARY OF THE INVENTION

It is an object according to the present invention to provide an improved sign, sign stand, and sign attachment apparatus suitable for portable temporary use.

Another object according to the present invention is to provide an improved sign attachment apparatus suitable for use with existing sign panels having an improved ease of mating with a sign panel, even in adverse conditions.

A further object according to the present invention is to provide an improved stand attachment apparatus fabricated from a minimum number of inexpensive components, which is lightweight but yet capable of withstanding forces such as those experienced by wind loading of a sign panel mounted by the attachment apparatus to a stand.

These and other objects according to the present invention which will become apparent from studying the appended description and drawings are provided in an apparatus for mounting a device having a rib member comprising:

an elongated mast;

a pair of mounting clips carried by the mast, spaced apart from each other to form a rib-receiving gap therebetween, and spaced from the outer surface of the mast so as to form pockets for receiving the rib, said mounting clips having open ends communicating with the pockets so as to permit a rib having a portion thereof disposed in said gap to enter said pockets by pivoting the rib in said gap so as to align greater portions of the rib in overlying relationship with the mast; and locking means on the mast to prevent movement of the rib out of said pockets.

DETAILED DESCRIPTION OF THE PREFERRED EMBODIMENT

Figure 1:
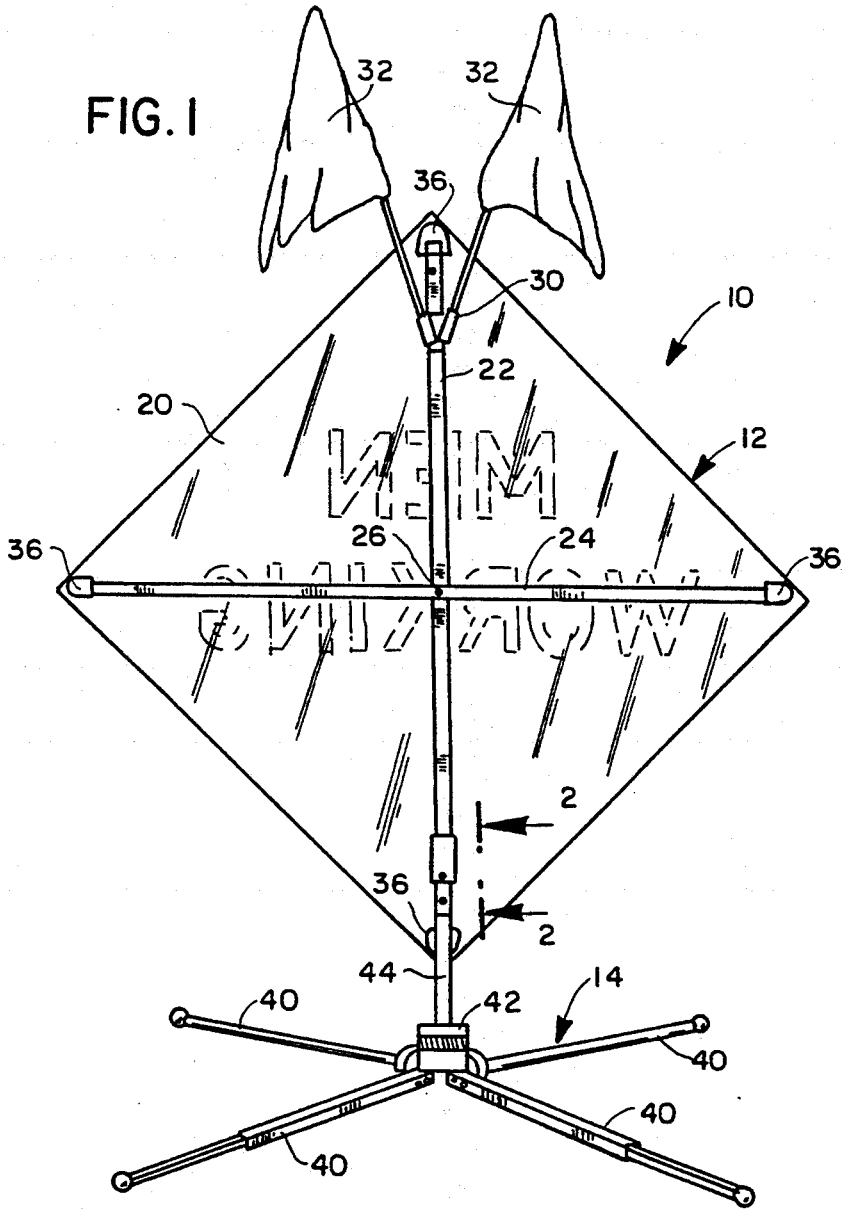
FIG. 1 is an elevational view of a sign constructed according to principles of the present invention.
Figure 2:
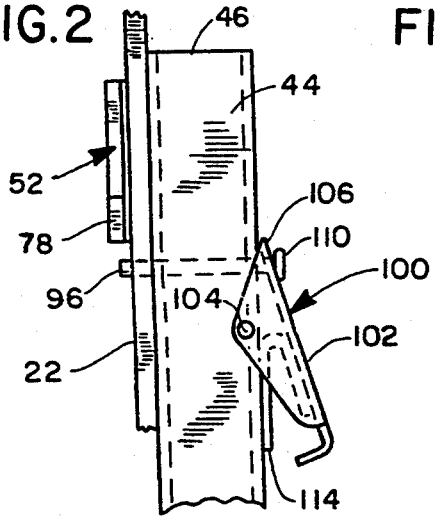
FIG. 2 is a fragmentary side elevational view taken along the line 2—2 of FIG. 1, showing the quick release mechanism in greater detail.
Figure 3:
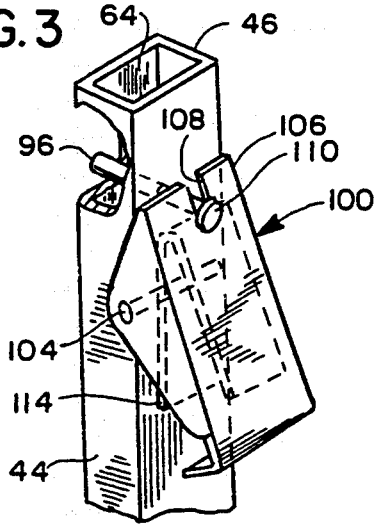
FIG. 3 is a perspective view of the quick release mechanism of FIG. 2.

Referring now to the drawings, and initially to FIG. 1, a sign is generally indicated at 10, and includes a sign panel assembly generally indicated at 12 and a stand or mounting base generally indicated at 14. The sign panel assembly 12 includes a sign panel 20 made of fabric or other flexible material and a pair of stiffening ribs 22, 24 which are pinned together at 26 so that the ribs can be rotated relative to one another to permit fold-up and erection of the sign panel. An optional flag holder 30 is attached at the upper end of vertical rib 22 and provides mounting for warning flag 32. Pockets 36 are attached to the sign panel 20 at each corner, for telescopic insertion of the ends of ribs 22, 24. The ribs 22, 24 are of elongated cross section as can be seen in FIGS. 5–8, for example, and are preferably made of a semi-flexible material such as a fiberglass composite. Thus, the ribs are easily bowed to permit insertion in the pockets 36. When a different legend is required to be displayed, the ribs 22, 24 are removed from the pockets 36 and a different sign panel is substituted. The sign panel is commercially available from the assignee of the present invention, as panel components of a Model 3000 sign system. Heretofore, a square tube metal adaptor was required for mounting to the sign stand; however, the adaptor is no longer required with mounting or attachment apparatus according to the present invention.

The mounting base 14 is of a type generally described in U.S. Pat. No. 4,886,232, assigned to the assignee of the present invention. The mounting base provides an improved spring loading system which has met with widespread commercial acceptance because of its light weight and its ability to withstand significant wind loading forces, including non-continuous forces such as hammering caused by passing traffic and wind gusts, for example. The mounting base includes a plurality of ground-contacting legs 40, a spring system 42 and a mast 44 of metal hollow tube construction. Further details concerning the mounting base 14 are available in U.S. Pat. No. 4,886,232 which is incorporated by references as fully set forth herein.

Figure 4:
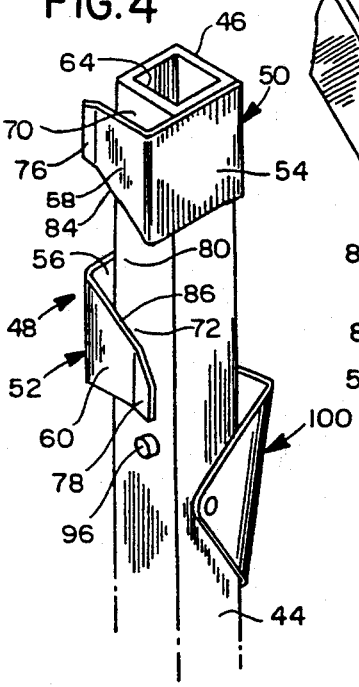
FIG. 4 is a fragmentary view of the upper stand portion of FIG. 1.

Referring now to FIG. 4, mast 44 has an upper free end 46 where mounting or attachment apparatus, generally indicated at 48, is located. The attachment apparatus includes a pair of mounting clips 50, 52 which are mounted to mast 44 adjacent free end 46, using conventional techniques such as spot welding. The mounting clips 50, 52 include endwalls 54, 56, respectively, which are attached to mast 44. Extending from endwalls 54, 56 are front walls 58, 60, respectively, which extend generally parallel to the front wall 64 of mast 44. The clip walls 58, 60 are spaced from mast wall 64 so as to form rib-receiving pockets 70, 72 with mast wall 64. The walls 58, 60 include angled free ends 76, 78 to aid in guiding a rib into the respective pockets 70, 72. The angled free ends 76, 78 are located at the openings of pockets 70, 72 and, as can be seen in FIG. 4, the pockets open in opposite directions.

Figure 5:
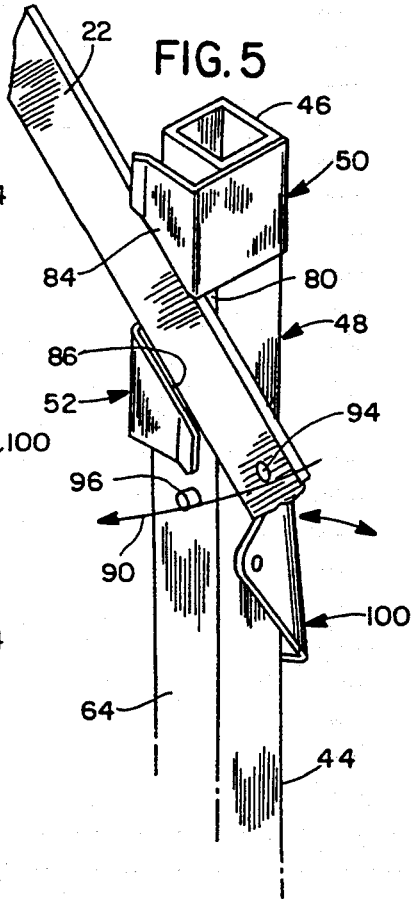
FIGS. 5 and 6 show assembly of the sign of FIG. 1.
Figure 6:
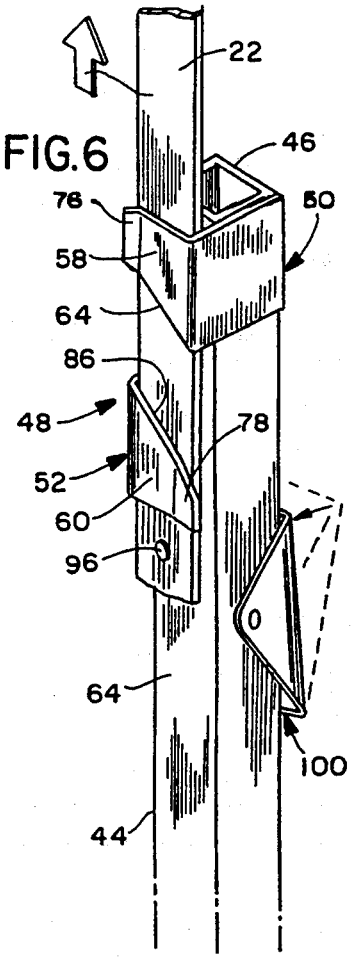

According to one aspect of the present invention, the mounting clips 50, 52 are spaced apart from one another along the longitudinal axis of mast 44 so as to form a rib-receiving gap 80 therebetween. The gap 80 allows the sign rib 22 to be inserted between the mounting clips 50, 52, as illustrated in FIG. 5, so as to allow the rib to contact mast wall 64. The shapes of the clip walls 58, 60 can vary as desired, but preferably, the clip walls include opposing edges 84, 86, on either side of gap 80, which extend at an angle to the longitudinal axis of mast 44. Preferably, the opposed edges 84, 86 are parallel to one another and are spaced for a relatively close, but non-interfering fit with rib 22 when inserted in gap 80 in the manner illustrated in FIG. 5.

Once the rib is received in the gap between the mounting clips 50, 52 and is conveniently aligned within the gap using mast wall 64 as a stop surface, the rib is then pivoted in gap 80 in the direction of arrow 90, so as to align greater portions of the rib in an overlying relationship with the mast 44. In the preferred embodiment, the endwalls 54, 56 act as stop surfaces which perform two alignment operations, one for the angular alignment of rib 22 in the fully installed position of FIG. 6, and the other for the relative alignment of the longitudinal axes of rib 22 and mast 44.

As illustrated in FIG. 5, rib 22 is provided with an aperture 94 which is preferably located along the longitudinal center line of the rib. Thus, the multiple alignment operations provided by mounting clips 50, 52 provide a ready alignment of aperture 94 with a moveable locking pin 96 which is mounted in mast 44. With the accurate, multi-planar alignment of the rib to the mast 44, aperture 94 in rib 22 can be sized for relatively close fit engagement with moveable pin 96, thus improving the strength and rigidity of the attachment apparatus.

In the preferred embodiment, locking pin 96 is moveable in directions along its central axis and has a rounded or bevelled free edge which cams against the surfaces of rib 22 during assembly and disassembly of the sign. The locking pin 96, as will be seen, is spring biased for maximum protrusion beyond mass wall 64. Thus, as rib 22 is received in the pockets of mounting clips 50, 52, a lateral edge of the rib contacts the free end of locking pin 96, causing the free end of the locking pin to be deflected within mast wall 64, against the spring bias urging the locking pin in an opposite direction. According to one feature of the present invention, the aperture 94 in rib 22 need not be aligned with locking pin 96 while the rib is being pivoted in the manner illustrated in FIG. 5. Such is, of course, possible, and will result in a locking of the rib within the mounting clips in a desired manner; however, this careful attention to the alignment of the sign components is not necessary. Instead, the aperture 94 may be aligned for deliberate initial positioning either above or below locking pin 96. In the operating example illustrated in the figures, the aperture 94 is initially located below pin 96. As mentioned above, the aperture 94 is aligned parallel to an axial center line by mounting clips 50, 52 for intersection with locking pin 96 upon longitudinal movement of rib 22, which longitudinal movement is accurately guided by the mounting clips. Preferably, a slight torque is applied to the mounting rib in the direction of arrow 90, as rib 22 is raised into a locking position where pin 96 is registered with aperture 94, to allow the spring bias force applied to the locking pin to lock the two members together.

As will be appreciated by those skilled in the art, a wide variety of conventional means may be used to bias the locking pin 96. For example, locking pin 96 can be provided with a shoulder internal to the hollow tubular mast 44, and a coil spring disposed within the mast could be employed to urge locking pin 96 to protrude through mass wall 64. Further, a number of conventional expedients are possible for withdrawing the locking pin 96 from engagement with the aperture 94 of rib 22. For example, the end of locking pin 96, remote from free end 96, could be provided with a pole ring to withdraw the locking pin into mast 44, allowing withdrawal of rib 22 from its fully locked position to a rotated position of FIG. 5, to facilitate withdrawal of the rib from a position between the mounting clips.

In the preferred embodiment, a manually engageable lever mechanism generally indicated at 100 is employed to selectively operate locking pin 96. Lever 102 is pinned at 104 to mast 44 to provide a rocking action for its free end 106. A slot 108 at the upper free end receives locking pin 96 and provides engagement with an enlarged head 110 of the locking pin. A flat spring member 114 biases the upper free end 106 of the lever toward mast 44, urging the free end of locking pin 96 to protrude past mast wall 64. Though not visible in the figures, the edges of the lever forming slot 108 are received in grooves in locking pin 96 so that movement of the lever toward the mast 44 pushes the free end of locking pin 96 past mast wall 64. Further details concerning the construction and operation of lever mechanism 100 are given in commonly assigned U.S. Pat. No. 4,954,008, which issued Sep. 4, 1990, and which is incorporated by reference as if fully set forth herein.

Referring again to FIGS. 5 and 6, as rib 22 is pivoted in gap 80 in the clockwise direction of arrow 90, the edge of rib 22 contacts the free end of locking pin 96, urging the locking pin to a retracted position which moves the free end 106 of lever 102 away from mast 44, thereby compressing the flat spring 114 and storing energy in the locking pin system. As the centerline of rib 22 is aligned to overlie the centerline of mast 44, the locking pin 96 remains in a recessed position until the rib 22 is advanced in a longitudinal direction so as to register aperture 94 with locking pin 96. At that time, the stored energy in the locking pin system urges the locking pin to be received in aperture 94, thus locking rib 22 against unintentional withdrawal from the mounting clips 50, 52.

Preferably, the front walls 58, 60 of the mounting clips are spaced for an interference fit with rib 22. That is, the pockets 70, 72 formed between the mounting clips and mast wall 64 are narrower than the thickness of rib 22 so as to provide a pinching of the rib against mast wall 64. The angled free ends 76, 78 facilitate insertion of the rib in the pockets, thus slightly prying walls 58, 60 of the mounting clips away from mast wall 64. Preferably, the end walls 54, 56 of the mounting clips 50, 52 are spaced apart by a distance for a close fit with rib 22. Thus, with insertion of locking pin 96 in rib 22, the rib is prevented from longitudinal or pivoting movement, and with the aforedescribed close fit with the lateral edges of the rib and the spring pressure of the rib against mast wall 64, the rib is securely held in position so as to adequately withstand multi-directed wind loading forces applied to the rib, especially noncontinuous impulse forces. The attachment apparatus described above is preferably fabricated using the upper end of mast 44. However, it will now be appreciated that the attachment apparatus can be separately fabricated, using a shorter section of tubing similar to that of the mast. The attachment apparatus, including the preferred lever mechanism 100, could then be coupled to the upper end of an existing mast or other type of conventional support base. Those skilled in the art will appreciate that significant cost savings can be realized if the attachment apparatus is incorporated with a support stand, as shown in FIGS. 1–6.

Figure 7:
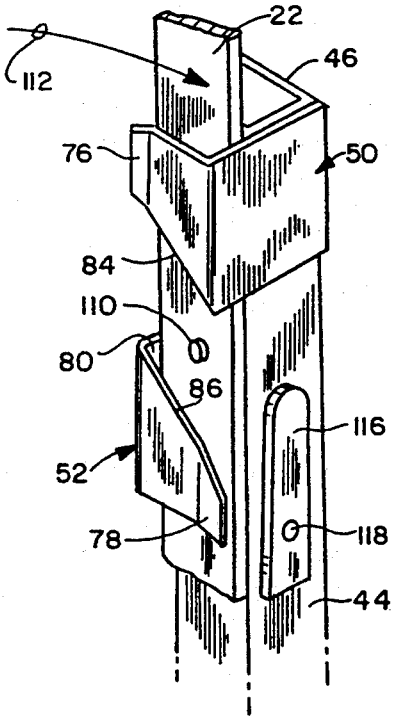
FIGS. 7 and 8 are perspective views of an alternative sign attachment apparatus according to the present invention.
Figure 8:
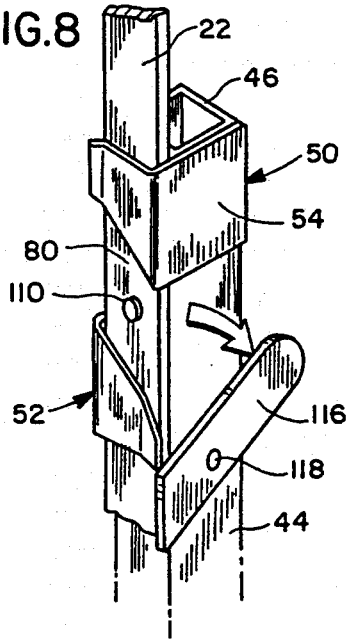

Referring now to FIGS. 7 and 8, an alternative embodiment of an attachment apparatus is shown. The rib 22 and mast 44 are the same as described above. Also, the same mounting clips 50, 52 are employed. However, the moveable locking pin described above is substituted for a fixed locking pin 110 mounted to mast 44 so as to be located in the gap 80 between the mounting clips. In this alternative embodiment, the rib 22 is inclined at an angle to the axis of mast 44, during mounting to the attachment apparatus, allowing insertion of the rib in gap 80. However, unlike the preceding embodiment, the aperture 94 in rib 22 must be aligned with the locking pin 110 at the onset of the sign assembly. To aid in this alignment, the opposed edges 84, 86 of the mounting clips and the out-turned free ends 76, 78 of the mounting clips provide guide surfaces so that the rib 22 can be advanced along its centerline, in gap 80, at an angle to the centerline of mast 44. Preferably, the mounting clips are spaced for a close fit with rib 22, further aiding in guiding the rib for alignment of aperture 94 with stationary locking pin 110. Thereafter, the rib 22 is advanced in a clockwise direction of arrow 112, as illustrated in FIG. 7, to the upright, fully aligned position illustrated in FIG. 8, with the end walls 54, 56 of the mounting clips providing a ready reference for the desired orientation.

Any number of conventional expedients may be employed to prevent unintentional pivoting of rib 22 away from the fully locked position illustrated in FIG. 8. For example, a turn buckle 116 pinned at 118 to mast 44 may be employed to engage one edge of rib 22, to prevent pivoting of the rib in a direction opposite to that of arrow 112. If desired, the moveable locking pin and manually engageable lever mechanism 100 described above may be employed in the embodiment of FIGS. 7 and 8. However, a second aperture must be formed in the rib.

Figure 9:
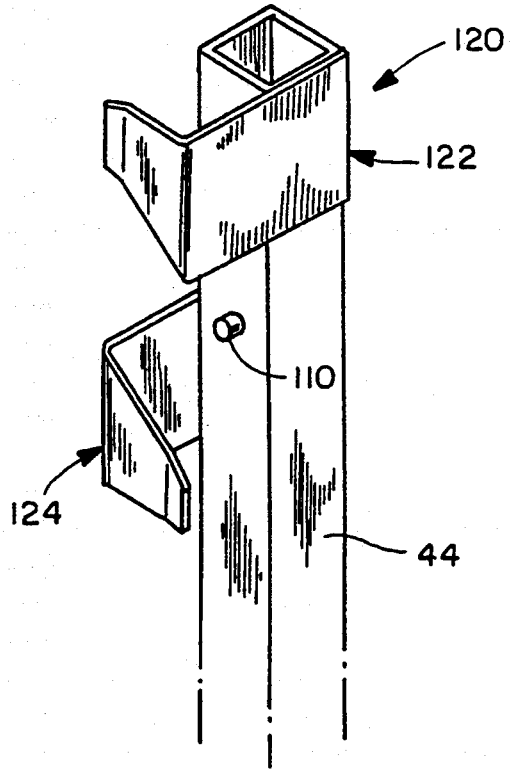
FIG. 9 is a perspective view of an alternative sign stand according to the present invention.

Referring now to FIG. 9, an alternative embodiment of a mounting apparatus is generally indicated at 120. Mounting clips 122, 124 are similar to the mounting clips 50, 52, except that the end walls of the mounting clips are extended to accommodate a rib of square cross section and of a size approximately equal to that of mast 44.

Figure 10:
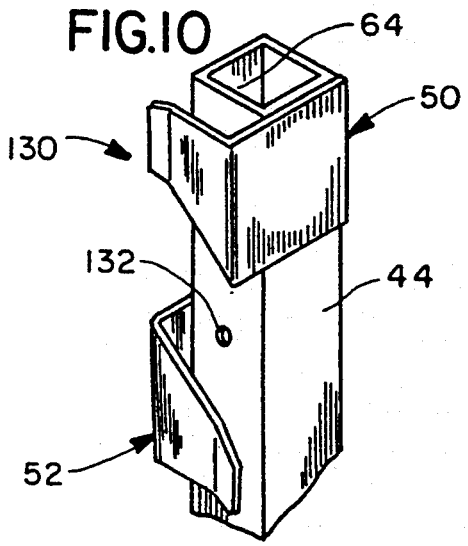
FIG. 10 is a perspective view of an alternative sign stand according to the present invention.

Referring now to FIG. 10, a further embodiment of mounting apparatus according to the present invention is generally indicated at 130. Mounting apparatus 130 is substantially identical to that illustrated in FIGS. 7 and 8, except that the stationary locating pin 110 is replaced by an aperture 132 formed in wall 64, between clips 50, 52. Aperture 132 receives a protrusion, such as a screw fastener or rivet, secured to a rib 22. Again, the modification to existing ribs 22 is a simple operation, which will adapt the ribs for use with the mounting support 130. A turn buckle, such as that shown in FIGS. 7 and 8, may be used to lock the rib in position.

Figure 11:
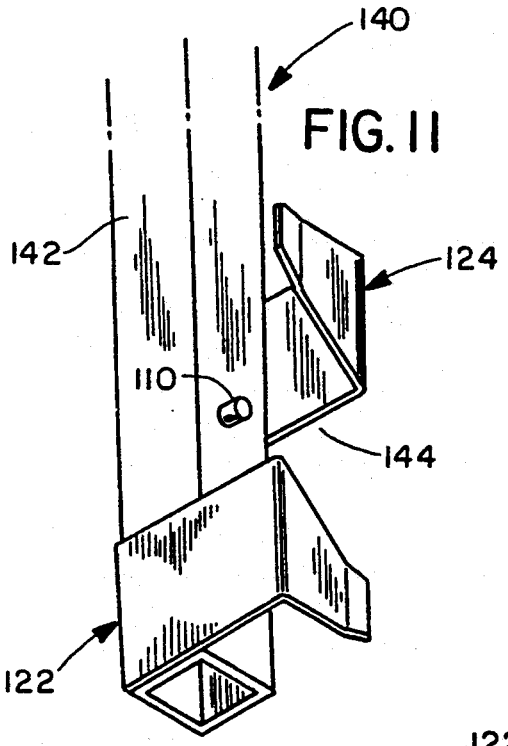
FIG. 11 is a perspective view of an alternative sign stand according to the present invention.

Referring now to FIG. 11, mounting apparatus is generally indicated at 140 and is substantially identical to an inversion of the mounting apparatus illustrated in FIG. 9. The mounting apparatus 140 is carried at the end of a sign or other device, and is adapted for attachment to an upstanding mast such as a square, hollow tube mast of proportions similar to that of mast 44. Mounting apparatus 140 includes a tubular body 142 which in the illustrated embodiment is similar in size and proportion to the mast 44. The mounting apparatus 140 can comprise an adaptor, having an upper end with conventional connection means or even including the arrangements illustrated above in FIGS. 1–10. Alternatively, the tubing 142 can comprise a rigid support of a sign panel. In any event, the mounting clips are provided on the upper, removable portion of the sign assembly, rather than on an upstanding mast, as described above. To install the mounting apparatus 140 on a mast, the mast is provided with an aperture for receiving the stationary pin 110. The apparatus 140 is initially rotated in a counterclockwise direction to align the gap 144 between mounting clips 122, 124 with the longitudinal axis of the mast. The tubing 142 is then pressed against the mast and rotated to the upright position shown in FIG. 11. Locking means, such as the turn buckle illustrated in FIGS. 7 and 8, can be employed to prevent counter-rotation, which would result in unintentional disassembly of the mounting apparatus 140 from the mast.

Figure 12:
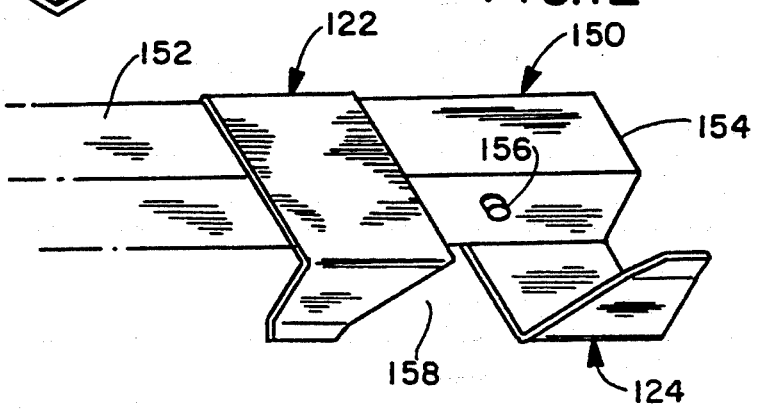
FIG. 12 is a perspective view of an alternative sign stand according to the present invention.

Referring now to FIG. 12, a mounting arrangement is generally indicated at 150, and has a generally horizontal or otherwise non-vertical alignment. The mounting attachment includes a tubular body 152 having a free end 154, and an opposed end secured in a conventional manner to a mast or other structural element. In essence, the mounting attachment 150 functions as a crossarm with mounting clips 122, 124 receiving a rib to be mounted in a horizontal position. The mounting operation is similar to that described above, with the rib being inclined at an acute angle to the central axis of tube 152, aligning the stationary pin 156 with an aperture in the rib, and thereafter pivoting the rib in the gap 158 so that the rib contacts the end walls of mounting clips 122, 124. If desired, a locking means such as the turnbuckle 116 of FIGS. 7 and 8 can be employed adjacent the free end 154 of tube 152 to maintain the rib in a fully locked condition.

It can now be seen that the present invention provides a quick and easy assembly of a sign panel or other device to a mounting base, requiring a minimum of manual dexterity. Further, the present invention is intended for application with a wide variety of systems. For example, the mounting clips and locking pins of the present invention could be employed with different types of mounting bases to provide ready mounting for a device having a vertically extending rib. Further, although the rib illustrated in the figures has an elongate, generally rectangular cross section, those skilled in the art will now appreciate that the mounting arrangement of the present invention can accommodate ribs having a wide variety of cross-sectional configurations. For example, to accommodate a rib of square cross section, the only adjustment needed is to properly dimension the end walls of the mounting clips so as to size the rib-receiving pockets for a close fit engagement with the ribs. The mounting arrangement of the present invention can be used with a variety of equipment, such as microphone booms, lighting devices and universal mountings for sensing devices and instrumentation. Other uses for the mounting arrangement according to the present invention will become apparent to those skilled in the art.

The preceding discussion has assumed a rib 22 provided with an aperture 94 for locking with the mounting arrangement associated with mast 44. However, the mounting arrangement of the present invention can also be employed with pre-existing sign standards, the only modification being required is the drilling of an aperture 94 in the vertical rib. Thus, with a simple modification, the mounting arrangement of the present invention can be used with a wide variety of sign components.

The drawings and the foregoing descriptions are not intended to represent the only forms of invention in regard to the details of its construction end manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Apparatus, comprising:

a rib having a generally rectangular cross section;

an elongated double-ended mast having an outer surface, a first end to be supported and a free end;

a pair of mounting clips carried by the mast adjacent the free end and spaced apart from each other to form a rib-receiving gap therebetween, and having portions spaced from the outer surface of the mast so as to form pockets for receiving the rib, said mounting clips having open ends communicating with the pockets so as to permit the rib, when disposed to have a portion thereof in said gap, to enter said pockets by pivoting the rib in said gap so as to align greater portions of the rib in overlying relationship with the mast; and locking means on the mast adjacent the mounting clips and remote from the mast first end to prevent movement of the rib out of said pockets.

2. The apparatus of claim 1 wherein said mounting clips have generally opposed edges on either side of said gap, extending at an acute angle to a central axis of said mast.

3. The apparatus of claim 1 wherein said mounting clips open in generally opposite directions so that said rib enters pockets formed by both clips at approximately the same time when pivoted in said gap.

4. The apparatus according to claim 3 wherein said mounting clips include free ends and out-turned portions at their free ends to introduce the rib into said pockets.

5. The apparatus according to claim 1 wherein said locking means comprises a locking pin having a central axis and movably mounted to said mast for movement along said central axis and spring bias means for urging said locking pin in a first direction.

6. The apparatus according to claim 5 further comprising manually engageable handle means connected to said locking pin for withdrawing said locking pin out of contact with the rib, in a direction to oppose the spring bias means.

7. The apparatus according to claim 6 wherein said manually engageable handle means comprises a manually engageable lever mounted for rocking and having a free end connected to said locking pin so as to move said locking pin back and forth, toward and away from the rib-receiving gap.

8. The apparatus according to claim 1 wherein said locking means comprises a projection between said mounting clips, outwardly extending from said outer surface of said mast, and said rib defines a recess for receiving said projection.

9. The apparatus according to claim 8 wherein said locking means further comprises a turnbuckle carried on said mast adjacent a portion of said rib so as to interfere with said rib to prevent rotation relative to said mounting clips so as to limit pivoting the rib in said gap.

10. A sign panel assembly for displaying a legend, comprising:

a double-ended mast having a generally rectangular cross section, an outer surface, a first end to be supported and a free end;

a sign panel means carrying said legend;

at least one support member attached to said sign panel means and having an outer surface;

a pair of mounting clips carried by the support member, spaced apart from each other to form a mast-receiving gap therebetween, and having portions spaced from the outer surface of the support member so as to form pockets for receiving the mast, said mounting clips having open ends communicating with the pockets so as to permit the mast, when disposed to have a portion thereof in said gap, to enter said pockets by pivoting the mast with respect to said mounting clips so as to align greater portions of the mast in overlying relationship with the support member; and locking means on the support member to prevent movement of the mast out of said pockets, positioned remote from said first end of said mast and adjacent the free end of said mast when said mast is disposed in said gap.

11. The apparatus according to claim 10 wherein said sign panel means comprises a sign panel made of flexible material and said sign panel means further comprises two supporting ribs pinned together at central portions thereof, and having end portions attached to said sign panel, with one of said supporting ribs comprising said at least one support member.

12. The apparatus of claim 10 wherein said mounting clips have generally opposed edges on either side of said gap, extending at an acute angle to a central axis of said support member.

13. The apparatus according to claim 12 wherein said mounting clips include free ends and out-turned portions at their free ends to introduce the mast into said pockets.

14. The apparatus of claim 10 wherein said mounting clips open in generally opposite directions so that the mast enters pockets formed by both clips at approximately the same time when pivoted in said gap.

15. The apparatus according to claim 10 wherein said locking means comprises a locking pin having a central axis and movably mounted to said mast for movement along said central axis and spring bias means for urging said locking pin a first direction.

16. The apparatus according to claim 15 further comprising manually engageable handle means connected to said locking pin for withdrawing said locking pin out of contact with the mast member, in a direction to oppose the spring bias means.

17. The apparatus according to claim 16 wherein said manually engageable handle means comprises a manually engageable lever mounted for rocking and having a free end connected to said locking pin so as to move said locking pin back and forth, toward and away from the mast-receiving gap.

18. The apparatus according to claim 10 wherein said locking means comprises a projection between said mounting clips, outwardly extending from said outer surface of said support member, and said mast defines a recess for receiving said projection.

19. The apparatus according to claim 18 wherein said locking means further comprises a turnbuckle carried on said support member adjacent a portion of said mast so as to interfere with said mast to prevent rotation relative to said mounting clips so as to limit pivoting the mast in said gap.

20. A stand, comprising:

a rib having a generally rectangular cross section;

a base;

at least one elongated double-ended support having a central axis an outer surface a first end to be supported and a free end, and the first end of said support attached to said base;

a pair of mounting clips carried by the support adjacent the free end and spaced apart from each other to form a rib-receiving gap therebetween, and having portions spaced from the outer surface of the support so as to form pockets for receiving the rib, said mounting clips having open ends communicating with the pockets so as to permit the rib, when disposed to have a portion thereof in said gap, to enter said pockets by pivoting the rib in said gap so as to align greater portions of the rib in overlying relationship with the support; and locking means on the support adjacent the mounting clips and remote from the mast first end, to prevent movement of the rib out of said pockets.

21. The apparatus of claim 20 wherein said mounting clips have generally opposed edges on either side of said gap, extending at an acute angle to a central axis of said support.

22. The apparatus of claim 20 wherein said mounting clips open in generally opposite directions so that said rib enters pockets formed by both clips at approximately the same time when pivoted in said gap.

23. The apparatus according to claim 22 wherein said mounting clips include free ends and out-turned portions at their free ends to introduce the rib into said pockets.

24. The apparatus according to claim 20 wherein said locking means comprises a projection outwardly extending from said rib, and a portion of said outer surface of said support between said mounting clips defining a recess for receiving said projection.

25. The apparatus according to claim 24 wherein said locking means further comprises a turnbuckle carried on said support adjacent a portion of said rib so as to interfere with said rib to prevent rotation relative to said mounting clips so as to limit pivoting the rib in said gap.

26. Apparatus, comprising:

a rib having a generally rectangular cross section;

an elongated double-ended mast having an outer surface, a first end to be supported and a free end;

a pair of mounting clips carried by the mast, spaced apart from each other to form a rib-receiving gap therebetween, and having portions spaced from the outer surface of the mast so as to form pockets for receiving the rib, said mounting clips having open ends communicating with the pockets so as to permit the rib, when disposed to have a portion thereof in said gap, to enter said pockets by pivoting the rib in said gap so as to align greater portions of the rib in overlying relationship with the mast;

locking means remote from the first end of the mast to prevent movement of the rib out of said pockets; and said locking means comprising one of said interfitting protrusion and said recess-defining surface on said mast between said mounting clips, with said locking means further comprising the other of said interfitting protrusion and said recess-defining surface on said rib.

27. A sign panel assembly for displaying a legend, comprising:

a double-ended mast having a generally rectangular cross section, an outer surface, a first end to be supported and a free end;

a sign panel means carrying said legend;

at least one support member attached to said sign panel and having an outer surface;

a pair of mounting clips carried by the support member, spaced apart from each other to form a mast-receiving gap therebetween, and having portions spaced from the outer surface of the support member so as to form pockets for receiving the mast, said mounting clips having open ends communicating with the pockets so as to permit the mast, when disposed to have a portion thereof in said gap, to enter said pockets by pivoting the mast in said gap so as to align greater portions of the mast in overlying relationship with the support member;

locking means remote from the first end of said mast to prevent movement of the mast out of said pockets, said locking means comprising one of said interfitting protrusion and said recess-defining surface on said support member between said mounting clips, with said locking means further comprising the other of said interfitting protrusion and said recess-defining surface on said mast.

28. A stand, comprising:

a rib having a generally rectangular cross section;

a base;

at least one elongated double-ended support having a central axis an outer surface a first end to be supported and a free end, and the first end of said support attached to said base;

a pair of mounting clips carried by the support adjacent the free end and spaced apart from each other to form a rib-receiving gap therebetween, and having portions spaced from the outer surface of the support so as to form pockets for receiving the rib, said mounting clips having open ends communicating with the pockets so as to permit the rib, when disposed to have a portion thereof in said gap, to enter said pockets by pivoting the rib in said gap so as to align greater portions of the rib in overlying relationship with the support;

locking means remote from the support first end, to prevent movement of the rib out of said pockets, said locking means comprising one of said interfitting protrusion and said recess-defining surface on said support between said mounting clips, with said locking means further comprising the other of said interfitting protrusion and said recess-defining surface on said rib.

* * * * *